US005542837A

United States Patent [19]

Johnston

[11] Patent Number: 5,542,837

[45] Date of Patent: Aug. 6, 1996

[54] MOLD BOX ASSEMBLY WITH PARTITION PLATES

[75] Inventor: Llewellyn L. Johnston, Vancouver, Wash.

[73] Assignee: Columbia Machine, Inc., Vancouver, Wash.

[21] Appl. No.: 373,936

[22] Filed: Jan. 13, 1995

[51] Int. Cl.[6] ..... B28B 7/24

[52] U.S. Cl. ..... 425/183; 425/186; 249/102; 249/112; 249/119; 249/129; 249/163; 249/166

[58] Field of Search ..... 249/129, 130, 249/113, 112, 163, 165, 166, 196, 219.1, 45, 102, 191; 425/183, 186; 29/525.1

[56] References Cited

U.S. PATENT DOCUMENTS

| | | | |
|---|---|---|---|
| 2,091,139 | 8/1937 | Crowell | 249/129 |
| 2,121,439 | 6/1938 | Menzel | 249/129 |
| 2,904,870 | 9/1959 | Hillberg | 249/45 |
| 5,059,110 | 10/1991 | Allison et al. | 425/432 |
| 5,297,772 | 3/1994 | Stefanick | 249/129 |
| 5,409,193 | 4/1995 | Baxter | 249/43 |

FOREIGN PATENT DOCUMENTS

| | | | |
|---|---|---|---|
| 508048 | 9/1920 | France | 249/129 |
| 630230 | 3/1963 | France | 249/129 |
| 2556511 | 6/1977 | Germany | 249/129 |
| 856809 | 8/1981 | U.S.S.R. | 249/129 |

OTHER PUBLICATIONS

Illustration entitled "*Mold Box Assembly,* 6 Block Machine, 8 x 8 x 16" Columbia Machine 1994.

*Primary Examiner*—Khanh P. Nguyen
*Attorney, Agent, or Firm*—Marger, Johnson, McCollom & Stolowitz, P.C.

[57] ABSTRACT

A mold box assembly for forming molded concrete products includes a pair of opposed substantially parallel end plates joined at both ends by a pair of opposed substantially parallel mounting brackets. A plurality of partition plates extend between the end plates to define a plurality of substantially identical cavities for forming molded products. A slot is formed along the inside of each end plate substantially along the length thereof. Tabs which extend from opposing ends of each partition plate include a stud transversely mounted on the end plate using ring nuts. The opposing tabs and studs of each end plate are received in opposing end plate slots. End liners are bolted to the inside surface of each end plate over the studs on each side of each partition plate with the ring nuts bearing against the surface of the end liner.

19 Claims, 2 Drawing Sheets

MOLD BOX ASSEMBLY WITH PARTITION PLATES

BACKGROUND OF THE INVENTION

1. Field of the Invention

The present invention relates to mold box assemblies and more particularly to such assemblies which are used to form molded products such as concrete products and which are assembled from a plurality of parts including partition plates which define boundaries of adjacent molded products.

2. Description of the Related Art

Machines for forming concrete products such as blocks, bricks and pavers, typically utilize a rectangular mold box assembly in which concrete is compressed to form the product. One such machine is described in U.S. Pat. No. 5,059,110 to Allison et al. for APPARATUS FOR FORMING CONCRETE BLOCKS HAVING PLURAL SEPARATELY DRIVEN VIBRATOR SETS. A typical mold box assembly includes a pair of opposed substantially parallel upright end plates and a pair of opposed substantially parallel upright mounting brackets positioned at opposite ends of the end plates which together with the end plates form a substantially rectangular mold box.

The mold box assembly is put together prior to mounting the same on the machine. In the course of creating the mold box assembly various liners, partition plates, and cores are installed in the interior of the box depending on the type of concrete product which is to be molded therein. Typically a plurality of substantially identical blocks, bricks or pavers are formed each time the box is filled with wet concrete. When the box is assembled it is mounted on the machine via bolts secured through holes in the mounting brackets on either end of the mold box assembly. The top and bottom of the mold box assembly are open so that a steel pallet which is supported on the machine can be urged against the bottom of the box while concrete is dropped into the top of the box. Thereafter a head plunger mounted on a vertically moveable portion of the machine lowers into the top of the mold box thereby compressing the concrete therein and forming the molded products. The molded products are stripped out of the box through the bottom side while continuing to be supported by the pallet.

The end plates in a typical prior art mold box assembly include bores spaced at intervals equivalent to the width of the block, paver, or other product to be formed in the mold box assembly. A slot is formed along the length of each end plate so that the slots in each end plate are facing one another with the bores being formed between the slot and the outer side of each end plate.

The usual mold box assembly forms a plurality of substantially identical concrete products in cavities defined by partition plates which extend between the end plates. Each partition plate includes a tab on opposing ends thereof to which a clevis having a bolt extending from one end thereof is pinned. Each tab and clevis are received in an end plate slot with the bolt extending through one of the bores in the end plate. Thereafter a washer and nut is used to secure the partition plate on each side of the end plate. End liners are then bolted to the inner walls of each end plate between adjacent partition plates and the mold box assembly is mounted on a block forming machine.

In operation, a steel pallet is urged against the lower side of the mold box assembly and wet concrete is poured into the top of the assembly. The mold box assembly can be vibrated during filling and during compaction, when shoes mounted on the machine are urged into the top of the mold box assembly to compress the wet concrete. Sometimes, especially when forming products which require a high degree of compaction, the end plates bow outwardly when the shoes compress the concrete product.

After the product is compressed, the pallet and shoes move downwardly thereby stripping the formed product from the lower side of the mold assembly. The molded product supported by the pallet is cured to form the finished product.

It would be desirable to provide a mold box assembly having partition plates which can be positioned at any selected place along the end plates rather than only at locations defined by bores in the end plates.

It would also be desirable to provide a mold box assembly in which the end plates are constrained from bowing outwardly when wet concrete is compressed therein.

SUMMARY OF THE INVENTION

The present invention comprises a mold box assembly having first and second end plates substantially parallel with one another. At least one partition plate extends from one end plate to the other and includes first and second opposing ends which substantially abut the inner sides of the end plates. A slot formed on the inner side of the first end plate extends substantially along the length thereof. The partition plate includes a tab extending from one end thereof which is received in the slot. Locking means extends laterally from the tab. A first plate is mounted on the first end plate over the slot adjacent one side of the partition plate and a second plate is mounted on the first end plate over the slot adjacent the other side of the partition plate. In one aspect, the partition plate is slidable along the slot when the tab and locking means are received in the slot and is constrained from such movement by the first and second plates. In another aspect, the locking means bears against each of said first and second plates.

The present invention also provides a method for assembling a mold box in which the first and second end plates are arranged in substantially parallel relation with one another with the slot on the first end plate facing the second end plate. Locking means which extend laterally from the partition plate tabs are installed thereon. The partition plate is positioned between the end plates with the tab locking means being received in the slot and opposing ends of the partition plate substantially abutting the end plates. The partition plate is slid along the end plates to a selected location after which a pair of mounting plates are mounted on the first end plate over the slot adjacent either side of the partition plate with the locking means disposed between the first end plate and the pair of plates.

It is a general object of the present invention to provide a method and apparatus for securing partition plates in a mold box assembly which overcome the above-enumerated disadvantages associated with prior art mold box assemblies.

It is a more specific object of the present invention to provide such a method and apparatus in which the partition plates are infinitely adjustable along the length of the mold box assembly.

It is another specific object of the present invention to provide such a method and apparatus in which the end plates are constrained from bowing movement during compression of the molded product.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
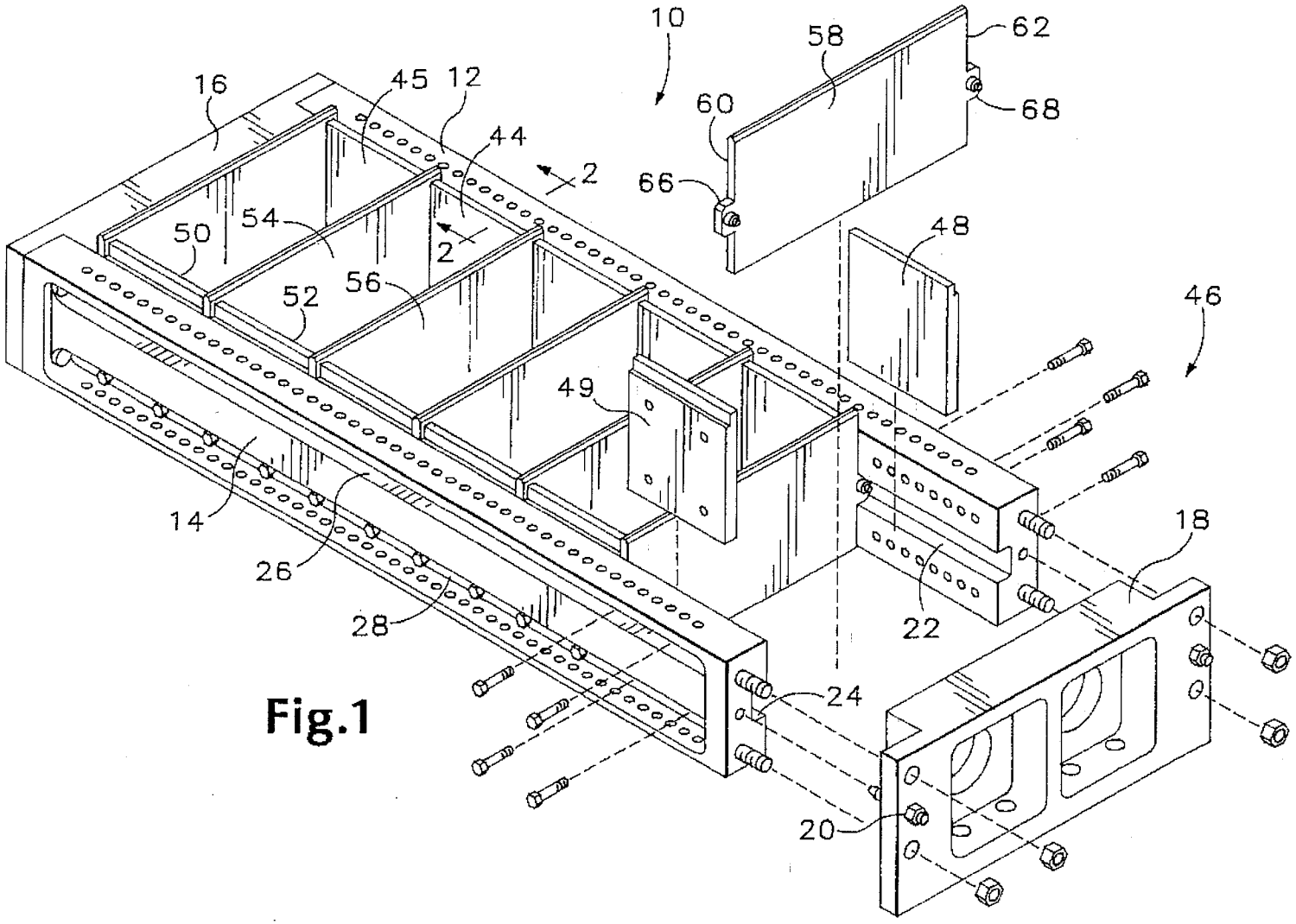
FIG. 1 is a partially exploded perspective view of a mold box assembly constructed in conformance with the present invention.

Indicated generally at 10 in FIG. 1 is a mold box assembly constructed in accordance with the present invention. Included therein is a first end plate 12, a second end plate 14, and a pair of mounting brackets 16, 18. End plates 12, 14 and mounting brackets 16, 18 are assembled to form a rectangular "box" having an open top and bottom as shown. Preferably, an alignment pin 20 and associated bolts as shown are installed on each corner as is more particularly described in U.S. patent application Ser. No. 08/361,790 filed in the U.S. Patent and Trademark Office on Dec. 21, 1994 and incorporated herein by reference.

Figure 2:
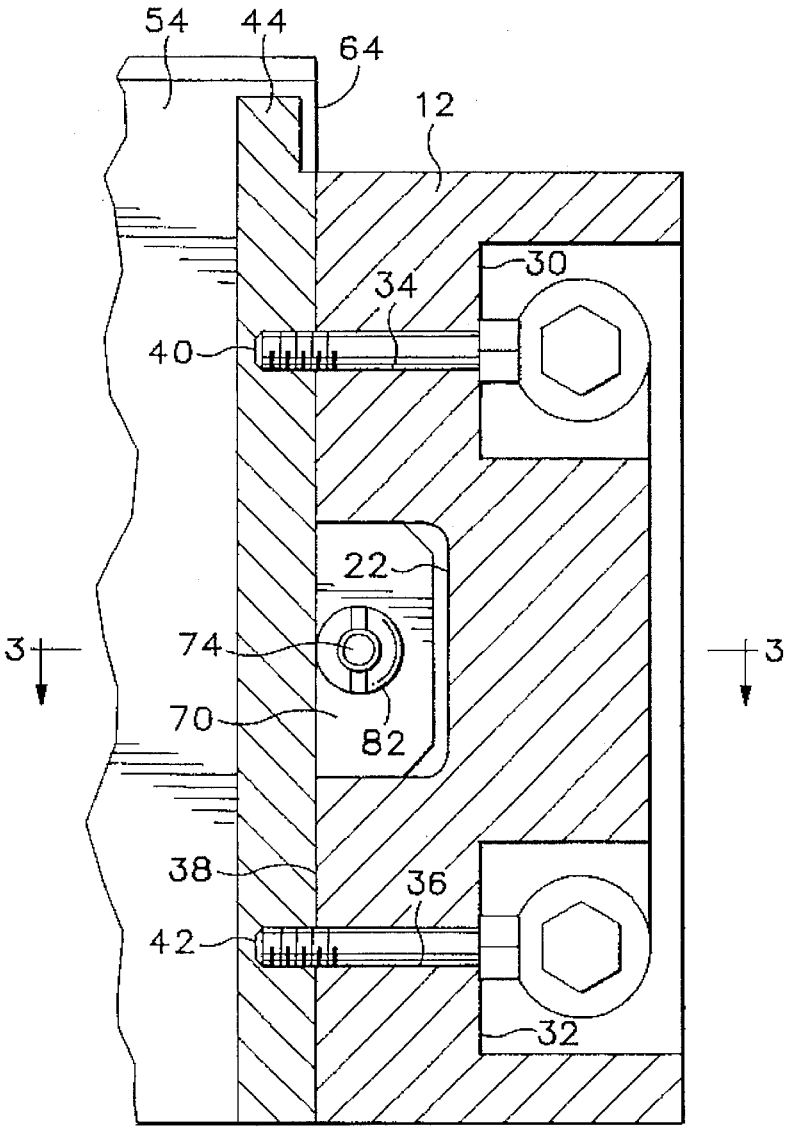
FIG. 2 is an enlarged sectional view taken along line 2—2 in FIG. 1.

End plates 12, 14 are substantially identical and include opposing slots 22, 24 along the length thereof. End plate 14 includes a pair of upper and lower slots 26, 28 in FIG. 1, which extend substantially along an upper and lower portion on the outer side of end plate 14. Similar slots 30, 32, in FIG. 2, are formed on the outer side of end plate 12. A plurality of bores, like bores 34, 36 in FIG. 2, extend between slots, like slots 30,32, respectively, and an inner surface 38 of end plate 12. Similar bores are formed in slots 26, 28 on end plate 14.

Bolts, like bolts 40, 42, are received in the bores and are used to secure end liners, like end liner 44 (viewable in FIGS. 1 and 2) and end liner 45 against surface 38 of end plate 12.

Similar bolts indicated generally at 46 in an exploded view are used to secure end liner 48, also exploded, to surface 38. An opposing end liner 49 is also shown in exploded view and is attached to end plate 14 with bolts (exploded) in the same manner.

As can be seen, additional end liners, like end liners 50, 52, are mounted on an inner surface of end plate 14 using similar bolts received in slots 26, 28 of end plate 14. A plurality of partition plates, like plates 54, 56, and plate 58 (shown in exploded view) extend between end plates 12,14. Each partition plate includes first and second opposing ends, like ends 60, 62 on plate 58 and end 64 on plate 54 (in FIG. 2). Each of the partition plates includes a tab, like tabs 66, 68 on partition plate 58 in FIG. 1, and tab 70 on partition plate 54 in FIG. 2, which extends from the end thereof. Each tab includes a bore, like bore 72 in tab 70, therethrough. A stud is received in each bore, like stud 74 is received in bore 72 in FIG. 3. Stud 74 includes a central, unthreaded portion received in bore 72 and a pair of threaded stud ends 76, 78 which extend from either side of bore 72. Each threaded end has a commercially available ring nut 80, 82 threadably engaged therewith. The ring nuts are tightened against tab 70, using a commercially available spanner wrench in a known manner, and together with the stud are referred to herein as locking means.

As can be seen in connection with partition plate 58 in FIG. 1, each tab of each partition plate includes substantially identical locking means mounted thereon.

Figure 3:
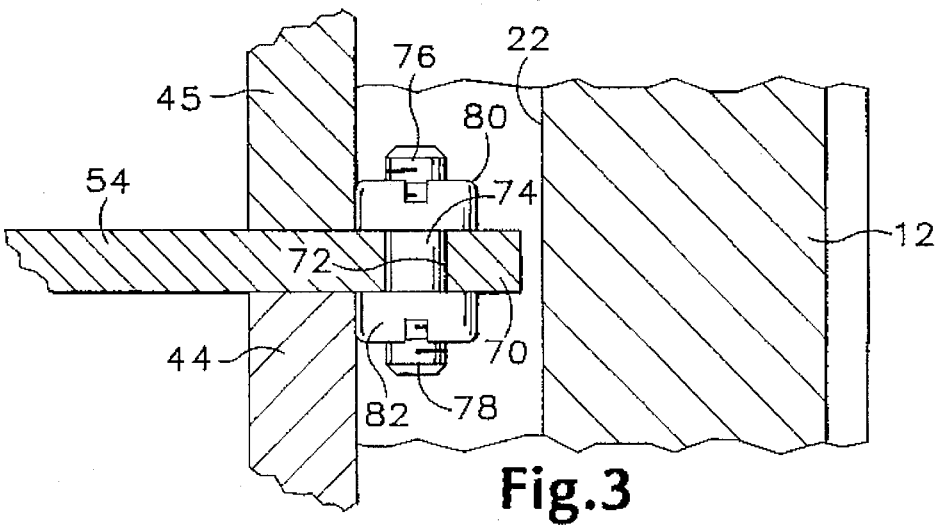
FIG. 3 is a further slightly enlarged sectional view taken along lines 3—3 in FIG. 2.

Consideration will now be made to the manner in which mold box assembly 10 is put together. A stud, like stud 74 is inserted in each bore on each partition plate tab and associated ring nuts are tightened on either end of the stud to provide locking means as shown in each of tabs 66, 68 on partition plate 58 in FIG. 1. Thereafter, end plates 12, 14 are positioned parallel with one another substantially as shown in FIG. 1 and mounting bracket 16 is secured to the end thereof as previously described herein. Preferably, a conventional spacer (not shown) is secured to the interior of the mold box assembly adjacent mounting bracket 16. Next, a partition plate assembly, such including locking means on each of the partition plate tabs, is positioned between end plates 12, 14 at the ends thereof opposite mounting bracket 16 with the tabs being received in slots 24, 22. The partition plate is slid along the length of the end plates until it abuts the spacer (not shown). Thereafter a set of end liners, like end liners 45, 50, are bolted onto end plates 12, 14 as shown. Partition plate 54 is then slid along slots 22,24 in the same manner until it abuts plates 45, 50 with ring nut 80 bearing against plate 45 as shown in FIG. 3. Thereafter, plates 44, 52 are installed using the bolts received in slots 30, 32 of end plate 12 and slots 26, 28 of end plate 14. The process continues until the mold assembly is substantially assembled with a conventional spacer being mounted on the mold assembly adjacent mounting bracket 18 in the same fashion as the spacer on the opposing end of assembly 10.

As can be seen at FIG. 3, ring nuts 80, 82 each bear against end liner 45,44 respectively. The ring nuts and stud (not visible) mounted on the tab on the opposite end of partition plate 54, and received in slot 24, are similarly urged against surfaces of end liners 50, 52.

The spaces between the partition plates in the mold box assembly 10 provide cavities into which wet concrete is compressed and thereafter stripped therefrom to form a molded concrete product. It can thus be seen that a product of varying width can be made using mold box assembly 10 by substituting end liners having a different width than those shown in FIG. 1. It can also be seen with reference to FIG. 3 that each of the end plates 12,14 are constrained against bowing outwardly during compression because the ring nuts on either end of the partition plates are flushly abutting an associated end liner.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

I claim:

1. A mold box comprising:

a first end plate;

a second end plate opposite said first end plate and being substantially parallel therewith;

at least one partition plate extending from one end plate to the other and having first and second opposing ends which substantially abut an inner side of the end plates;

a slot formed on the inner side of said first end plate and extending substantially along the length thereof;

a tab extending from one end of said partition plate, said tab being received in said slot;

locking means extending laterally from said tab, said partition plate being slidable substantially along the entire length of said slot;

a first plate mounted on said first end plate over said slot adjacent one side of said partition plate; and a second plate mounted on said first end plate over said slot adjacent the other side of said partition plate, said first and second plates constraining movement of said partition plate relative to said slot, wherein said locking means is disposed intermediate said first end plate and said first and second plates.

2. The mold box of claim 1 wherein said first and second plates constrain movement of said partition plate along said slot.

3. The mold box of claim 1 wherein said locking means bears against said first and second plates.

4. The mold box of claim 3 wherein said locking means comprises a stud mounted on said tab.

5. The mold box of claim 1 wherein said mold box further comprises:

a second slot formed on the inner side of said second end plate and extending substantially along the length thereof;

a second tab extending from the other end of said partition plate, said tab being received in said second slot;

a second locking means extending laterally from said second tab, said partition plate being slidable substantially along the entire length of said second slot;

a third plate mounted on said second end plate over said second slot adjacent said one side of said partition plate;

a fourth plate mounted on said second end plate over said second slot adjacent said other side of said partition plate, said third and fourth plates constraining movement of said partition plate relative to said second slot, wherein said locking means is disposed intermediate said first end plate and said first and second plates.

6. The mold box of claim 5 wherein said first-mentioned locking means bears against said first and second plates and wherein said second locking means bears against said third and fourth plates.

7. A mold box in assembled condition comprising:

a first end plate;

a second end plate opposite said first end plate and being substantially parallel therewith;

at least one partition plate extending from one end plate to the other and having first and second opposing ends which substantially abut an inner side of the end plates;

a slot formed on the inner side of said first end plate and extending substantially along the length thereof;

a tab extending from one end of said partition plate, with a bore disposed laterally in said tab and with said tab being received in said slot;

an elongated locking rod extending laterally from said tab and disposed through the bore in said tab, with said partition plate being slidable substantially along the entire length of said slot when said tab and said locking rod are received in said slot;

a first plate mounted on said first end plate over said slot adjacent one side of said partition plate; and a second plate mounted on said first end plate over said slot adjacent the other side of said partition plate, said locking rod bearing against each of said plates in a locked condition.

8. The mold box of claim 7 wherein said first and second plates constrain movement of said partition plate.

9. The mold box of claim 8 wherein said first and second plates constrain movement of said partition plate along said slot.

10. The mold box of claim 7 wherein said mold box further comprises:

a second slot formed on the inner side of said second end plate and extending substantially along the length thereof;

a second tab extending from the other end of said partition plate, with a bore disposed in said second tab and with said tab being received in said second slot;

a second locking rod extending laterally from said second tab and disposed through the bore in said second tab;

a third plate mounted on said second end plate over said second slot adjacent said one side of said partition plate;

a fourth plate mounted on said second end plate over said second slot adjacent said other side of said partition plate, said second locking rod bearing against each of said third and fourth plates in a locked condition.

11. The mold box of claim 7 wherein said locking means comprises a stud mounted on said tab.

12. The mold box of claim 11 wherein said stud extends through a bore in said tab and wherein said mold box assembly further includes a pair of ring nuts mounted on either end of said stud, said ring nuts bearing against each of said first and second plates.

13. The mold box of claim 1 wherein said tab and said locking means are disposed within said slot.

14. A mold box comprising:

a first end plate;

a second end plate opposite said first end plate and being substantially parallel therewith;

at least one partition plate extending from one end plate to the other and having first and second opposing ends which substantially abut an inner side of the end plates;

a slot formed on the inner side of said first end plate and extending substantially along the length thereof;

a tab extending from one end of said partition plate, said tab being received in said slot;

locking means extending laterally from said tab, said partition plate being slidable substantially along the entire length of said slot when said tab and said locking means are received in said slot;

a first plate mounted on said first end plate over said slot adjacent one side of said partition plate; and a second plate mounted on said first end plate over said slot adjacent the other side of said partition plate, said first and second plates constraining movement of said partition plate relative to said slot.

15. The mold box of claim 14 wherein said first and second plates constrain movement of said partition plate along said slot.

16. The mold box of claim 15 wherein said locking means bears against said first and second plates.

17. The mold box of claim 16 wherein said locking means comprises a stud mounted on said tab.

18. The mold box of claim 14 wherein said mold box further comprises:

a second slot formed on the inner side of said second end plate and extending substantially along the length thereof;

a second tab extending from the other end of said partition plate, said tab being received in said second slot;

a second locking means extending laterally from said second tab, said partition plate being slidable substantially along the entire length of said second slot when said second tab and second locking means are received in said slot;

a third plate mounted on said second end plate over said second slot adjacent said one side of said partition plate; and a fourth plate mounted on said second end plate over said second slot adjacent said other side of said partition plate, said third and fourth plates constraining movement of said partition plate relative to said second slot, wherein said locking means is disposed intermediate said first end plate and said first and second plates.

19. The mold box of claim 18 wherein said first-mentioned locking means bears against said first and second plates and wherein said second locking means bears against said third and fourth plates.

* * * * *